US007887057B1

(12) United States Patent
Brodie et al.

(10) Patent No.: US 7,887,057 B1
(45) Date of Patent: Feb. 15, 2011

(54) HIKER BOARD GAME SYSTEM

(76) Inventors: Mary Ann Brodie, 226 Firestone Dr., Roseville, CA (US) 95678; Sherry Brodie, 5333 Primrose Dr. 16A, Fair Oaks, CA (US) 95628

( * ) Notice: Subject to any disclaimer, the term of this patent is extended or adjusted under 35 U.S.C. 154(b) by 0 days.

(21) Appl. No.: 12/486,197

(22) Filed: Jun. 17, 2009

Related U.S. Application Data

(60) Provisional application No. 61/082,538, filed on Jul. 22, 2008.

(51) Int. Cl.
*A63F 3/00* (2006.01)

(52) U.S. Cl. ..... 273/242; 273/308

(58) Field of Classification Search ..... 273/242, 273/243, 298, 308
See application file for complete search history.

(56) References Cited

U.S. PATENT DOCUMENTS 6,561,513 B1 * 5/2003 DeGeorge ..... 273/262

* cited by examiner

*Primary Examiner*—Vishu Mendiratta
(74) *Attorney, Agent, or Firm*—Neustel Law Offices

(57) ABSTRACT

A hiker board game system for efficiently providing a challenging and fast paced game in which players may follow alternate paths around the board during game play. The hiker board game system generally includes a game board including at least one pathway having a plurality of spaces, a plurality of tokens movable along the spaces, a chance element to determine a number of spaces for the tokens to move, a plurality of checkpoints positioned along the spaces and a plurality of progress cards each sequencing the checkpoints in a specific order, wherein the specific order is different for each of the progress cards. Each game player is assigned a token and a unique progress card to layout the specific order that the plurality of checkpoints are to be reached by each game player. A carrying case for the game board is also described.

16 Claims, 11 Drawing Sheets

32

32

32

10

HIKER BOARD GAME SYSTEM

CROSS REFERENCE TO RELATED APPLICATIONS

I hereby claim benefit under Title 35, United States Code, Section 119(e) of U.S. provisional patent application Ser. No. 61/082,538 filed Jul. 22, 2008. The 61/082,538 application is currently pending. The 61/082,538 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to games and more specifically it relates to a hiker board game system for efficiently providing a challenging and fast paced game in which players may follow alternate paths around the board during game play. A carrying case for the game board is also described herein.

2. Description of the Related Art

Any discussion of the related art throughout the specification should in no way be considered as an admission that such related art is widely known or forms part of common general knowledge in the field.

Board games have been around for years and are a popular past time for many families and groups of individuals allowing for healthy interaction between the individuals. However, many classic board games require lengthy playing times and have been replayed over and over many times. Players generally follow the same route in the same direction of play each time they play the board game. The repetitious play of the board games and the lengthy duration of each game play cause these board games to be very tedious and monotonous. In addition, in many board games, artwork is nonexistent or minimal further adding to the monotonous play of the board games.

Recently, many computer games have replaced classic board games. Computer games often times isolate players, especially children, which can reduce their interaction with families and friends. Because of the inherent problems with the related art, there is a need for a new and improved hiker board game system for efficiently providing a challenging and fast paced game in which players may follow alternate paths around the board during game play.

BRIEF SUMMARY OF THE INVENTION

A system for efficiently providing a challenging and fast paced game in which players may follow alternate paths around the board during game play. The invention generally relates to a game which includes a game board including at least one pathway having a plurality of spaces, a plurality of tokens movable along the spaces, a chance element to determine a number of spaces for the tokens to move, a plurality of checkpoints positioned along the spaces and a plurality of progress cards each sequencing the checkpoints in a specific order, wherein the specific order is different for each of the progress cards. Each game player is assigned a token and a unique progress card to layout the specific order that the plurality of checkpoints are to be reached by each game player. A carrying case for the game board is also described.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
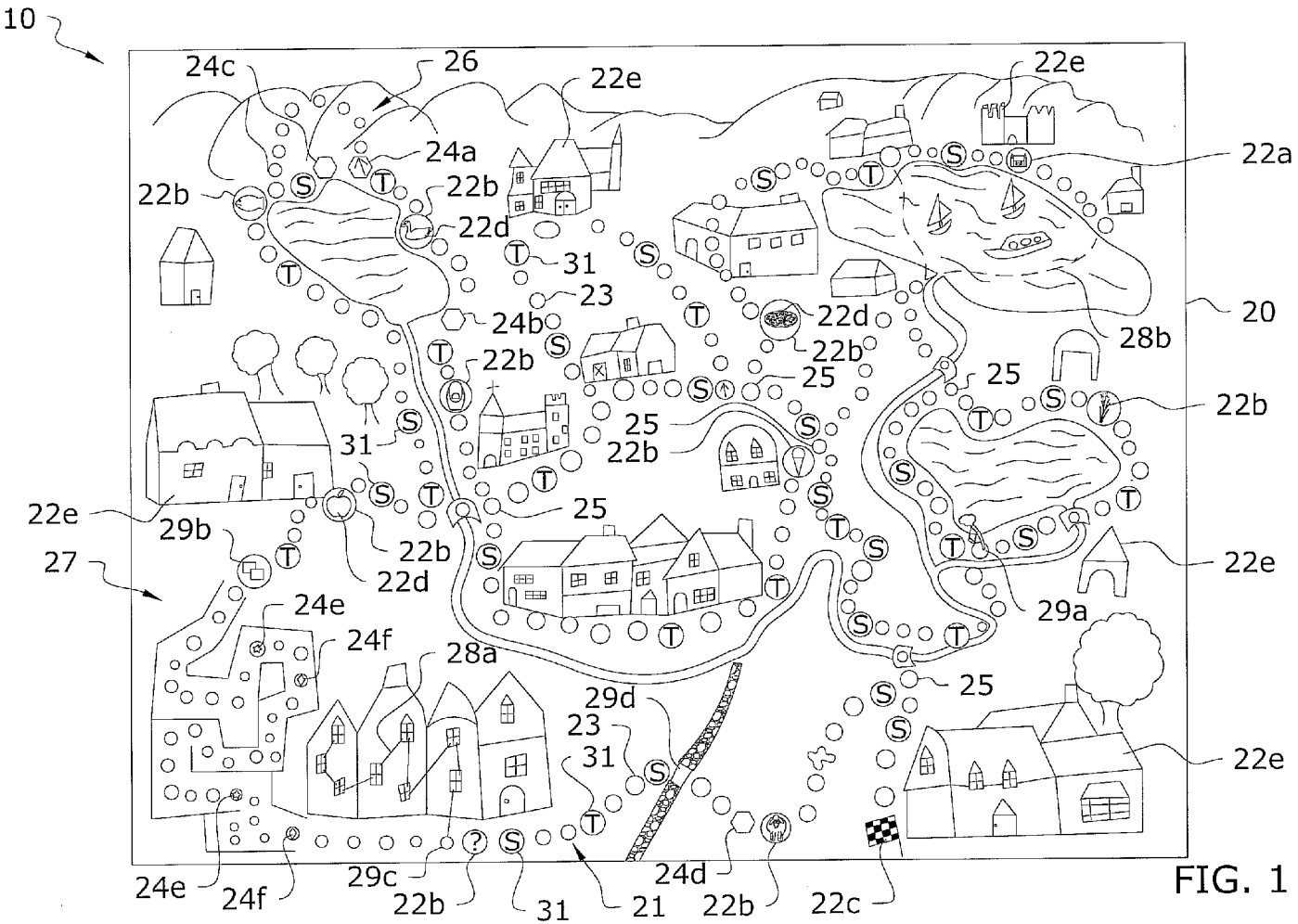
FIG. 1 is an illustration of the game board.

Turning now descriptively to the drawings, in which similar reference characters denote similar elements throughout the several views, FIGS. 1 through 10 illustrate a hiker board game system 10, which comprises a challenging and fast paced game in which players may not necessarily follow the same sequence of play during each use of the game and also providing a compact carrying case 60 for storing the game. For instance, two players playing the game 10 at the same time may travel differently throughout the game board 20.

The game board 20 includes at least one pathway 21 having a plurality of spaces, a plurality of tokens 30 movable along the spaces, a chance element 36 to determine a number of spaces for the tokens 30 to move, a plurality of checkpoints 22*a*, 22*b*, 22*c* positioned along the spaces and a plurality of progress cards 40 each sequencing the checkpoints 22*a*, 22*b*, 22*c* in a specific order, wherein the specific order is different for each of the progress cards 40. Each game player is assigned a token 30 and a unique progress card 40 to layout the specific order that the plurality of checkpoints 22*a*, 22*b*, 22*c* are to be reached by each game player. Among others, the spaces include the checkpoint spaces 22*a*, 22*b*, 22*c*, regular spaces 23, detour spaces 24, intersecting spaces 25, spaces within the bog 26, maze 27, or along a shortcut 28*a*, spinner spaces 29, and card spaces 31. A carrying case 60 for the game board 20 and game components is also described.

B. Game Board

The game board 20 is preferably a colorfully illustrated type game board 20 that may be folded into a smaller size in which to carry, transport and store the game board 20. The game board 20 is preferably comprised of a synthetic, silicone type board. The game board 20 includes a pathway 21 specifically positioned upon the game board 20 to lead to a plurality of checkpoints 22*a*, 22*b*, 22*c*. The pathway 21 may be represented in various manners, such as a hiking trail represented by a dirt trail, a plurality of irregular shaped circles (representing rocks), or various other manners preferably that of which a hiker would walk upon. The pathway 21 is described in singular form; however it is appreciated that the game board 20 actually includes a plurality of pathways 21 all interconnected via the intersection spaces 25, wherein the players may travel along any of the pathways 21 at a given time to reach a desired checkpoint 22*b*, 22*c*. It is appreciated that the game board 20 and present invention may be configured in a software embodiment in alternate embodiments of the present invention.

The checkpoints 22*a*, 22*b*, 22*c* (preferably 10 total) may also be represented in various manners, such as correlating to the specific name they are given, in the shape of castles or various others. The pathways 21 preferably include a plurality of intersections (i.e. intersecting pathway space 25) wherein players may take different routes to reach an associated checkpoint 22*a*, 22*b*, 22*c*. Along with each checkpoint 22*a*, 22*b*, 22*c* being marked on the pathway 21, each checkpoint 22*a*, 22*b*, 22*c* is also preferably illustrated via a pictorial representation 22*d* of the checkpoint 22*a*, 22*b*, 22*c* similar to that displayed as the illustration 47 on the map 46 of the progress card 40. Along with the pictorial representations 22*d* of each location space 22*a*, 22*b*, 22*c*, a building structure 22*e*, such as a castle, mid evil home, or other building may be represented alongside each location space 22*a*, 22*b*, 22*c*. The pathway 21 of the game board 20 thus preferably includes a plurality of different routes in which not all parts of the pathway 21 may be used by the players during a single game play.

The pathway 21 also includes various other spaces other than checkpoints 22*a*, 22*b*, 22*c*, such as but not limited to regular spaces 23 and detour spaces, such as a bog detour space 24*a*, a bog space 24*b*, a "Wrong Way Inn" space 24*c*, a sheep pile space 24*d*, a star space 24*e*, a diamond space 24*f*, a duck space 22, a maze 27, a "Fallen Tree Swing" space 29*a*, a "Window Walk Shortcut" spaces 29*b* and 29*c*, a "Kissing Gate" space 29*d* and various others. The various spaces including checkpoints 22*a*, 22*b*, 22*c* preferably adhere to the player's sense of touch, smell, taste to make playing the game an entertainment event. Such spaces are enhanced by names or properties relating to pizza, ice cream, scones, tea and various others as an example.

C. Game Pieces

The present invention also preferably includes the use of various game pieces, such as but not limited to hiker tokens 30, chance element 36 (e.g. dice), writing tools 38, progress cards 40 (i.e. "Hiking Pathway Cards") and playing cards 32 such as "Swan" cards and "Tarn" cards. The hiker token 30, chance element 36 and writing tool 38 are preferably color coordinated for each respective player. The progress cards 40 area also preferably laminated, wherein the writing tool 38 may be comprised of a dry erase marker to write upon the progress card 40 and subsequently be washed off of the progress card 40 when game play is finished. The progress cards 40 also include a map 46 showing illustrations 47 representative of the checkpoints 22*a*, 22*b*, 22*c* and also a detailed text list 42 having the destination names 44 for the user to mark when they have reached a desired checkpoint 22*a*, 22*b*, 22*c*.

The present invention also includes a spinner 50. The spinner 50 includes a plurality of spots 52 positioned around a circle in pie-shaped form. An arrow 54 is rotatably mounted to the center of the spinner 50 and may be spun by the player to point to a specific spot 52 on the spinner 50.

The checkpoints 22*a*, 22*b*, 22*c* are accounted for on the progress card 40 via a checklist 42 including a plurality of destination names 44 and the map 46 including a plurality of illustrations 47. For example the player lands on a or passes a checkpoint 22*a*, 22*b*, 22*c* and then "checks" off that corresponding destination name 44 on the checklist 42 of the progress card 40 before moving to the next checkpoint 22*a*, 22*b*, 22*c* on the game board 20. The player may also mark or move upon the corresponding illustration 47 of the map 46 for a more visual representation of what checkpoint 22*a*, 22*b*, 22*c* the player has reached and has left. The next checkpoint 22*a*, 22*b*, 22*c* on the game board 20 is prescribed by the next ordered destination name 44 on the checklist 42 and illustration 47 on the map 46 of the progress card 40. If a player has to remove a destination name 44 from their checklist 42 (as a result of a "Swan" or "Tarn" card) the player simply erases or removes the associated check mark or other marking in the checkbox of the destination name 44.

D. Carrying Case

The present invention may also include a carrying case 60. The carrying case 60 is preferably adapted to carry and store the game board 20 and all of the associated game pieces of the present invention. The carrying case 60 preferably includes a pair of straps 70 to be carried in a backpack-like manner. The carrying case 60 also preferably includes a plurality of pockets 61, 64, 67 to receive and store the game board 20 and game pieces.

Figure 9:
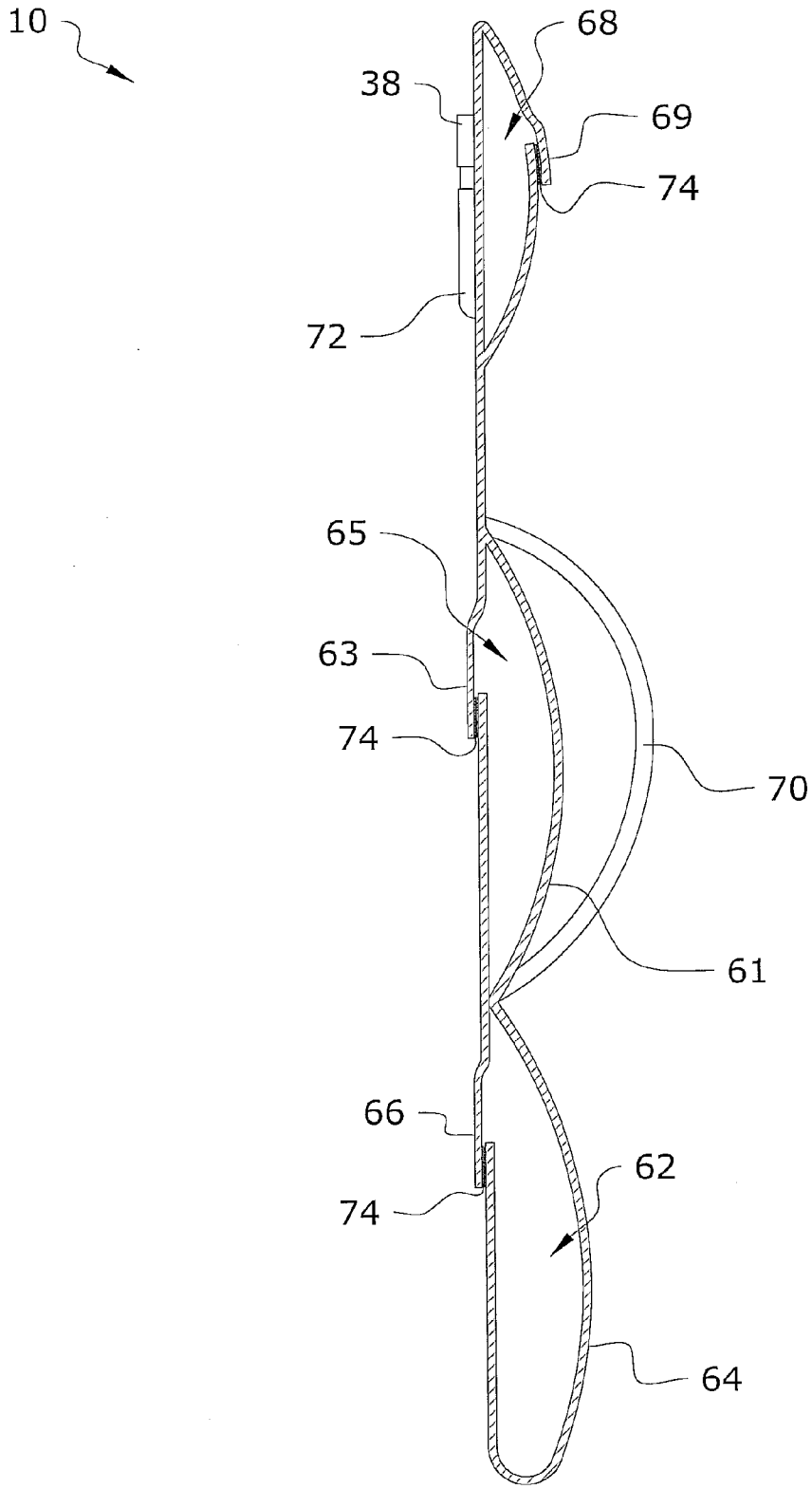
FIG. 9 is a side sectional view of the carrying case in an open position.
Figure 10:
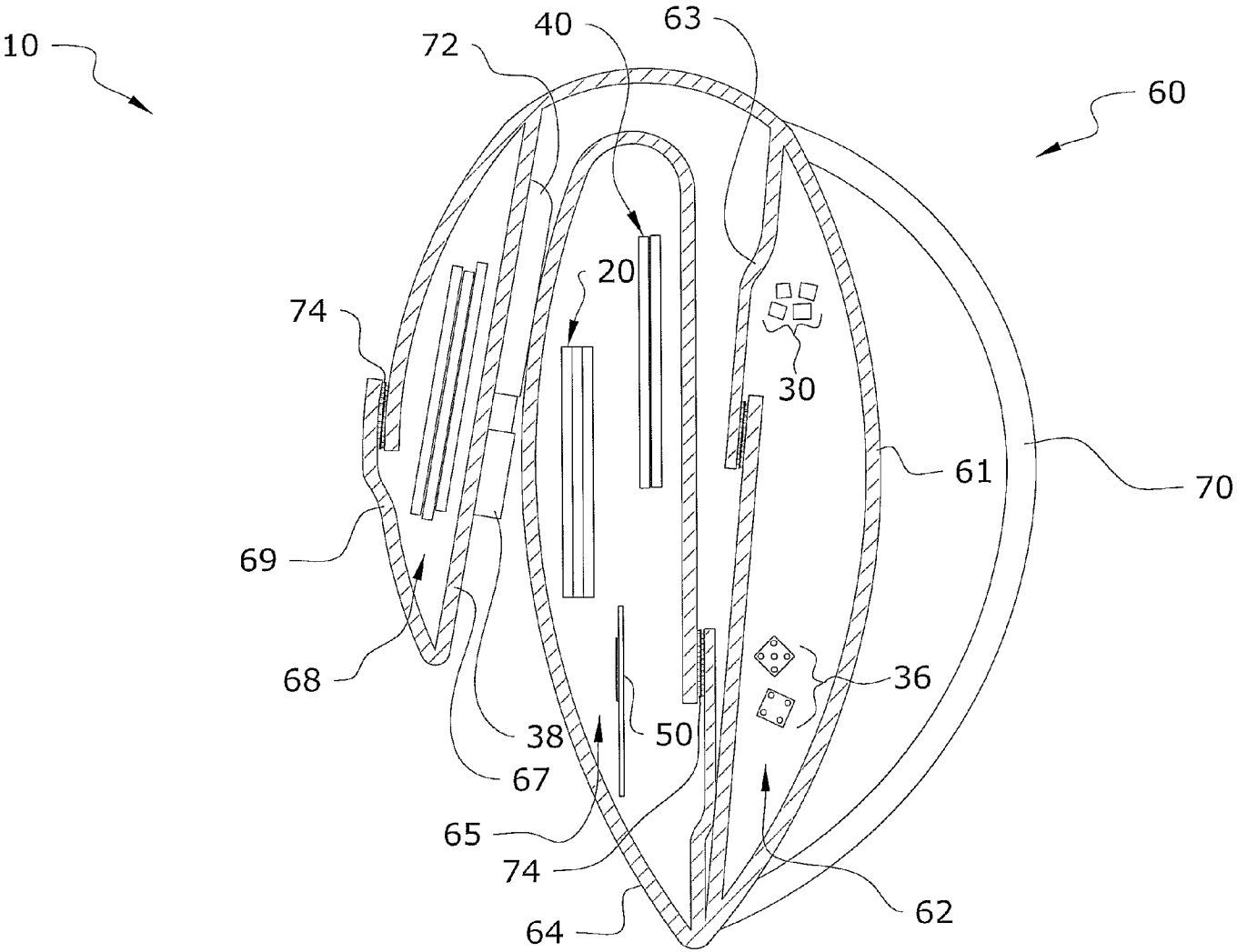
FIG. 10 is a side sectional view of the carrying case in a closed position and including the game board and various game pieces enclosed within.

In the preferred embodiment, the carrying case 60 includes a first inner pocket 61, a second inner pocket 64 and an outer pocket 67. The pockets 61, 64, 67 are all individually sealed via a pivotal flap 63, 66, 69 secured to the respective pocket 61, 64, 67 by various types of fastening members 74 (e.g. hook and loop fasteners). Each pocket 61, 64, 67 includes a respective cavity 62, 65, 68, wherein the first cavity 62, the second cavity 65 and the third cavity 68 are preferably separated from one another. The pockets 61, 64, 67 preferably fold upon one another in a manner so as to compact the size of the carrying case 60 when traveling as illustrated in FIG. 9. The carrying case 60 also preferably includes a plurality of sleeves 72 to secure the writing tools 38 to the inside of the carrying case 60 on an outside of one of the pockets 61, 64, 67.

E. Operation of Preferred Embodiment

Figure 3A:
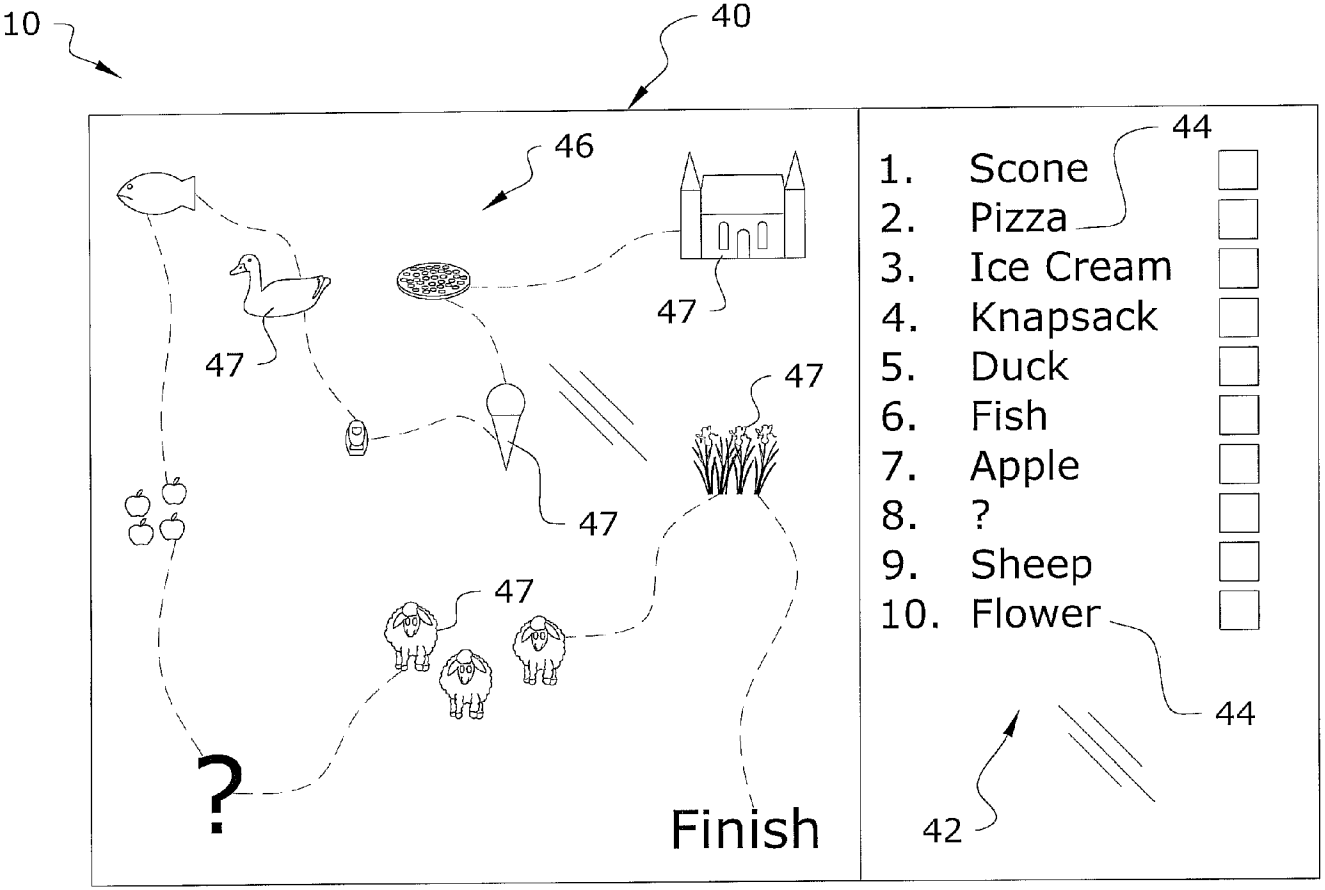
FIG. 3*a*-3*b* are illustrations of different sequenced progress cards.
Figure 3B:
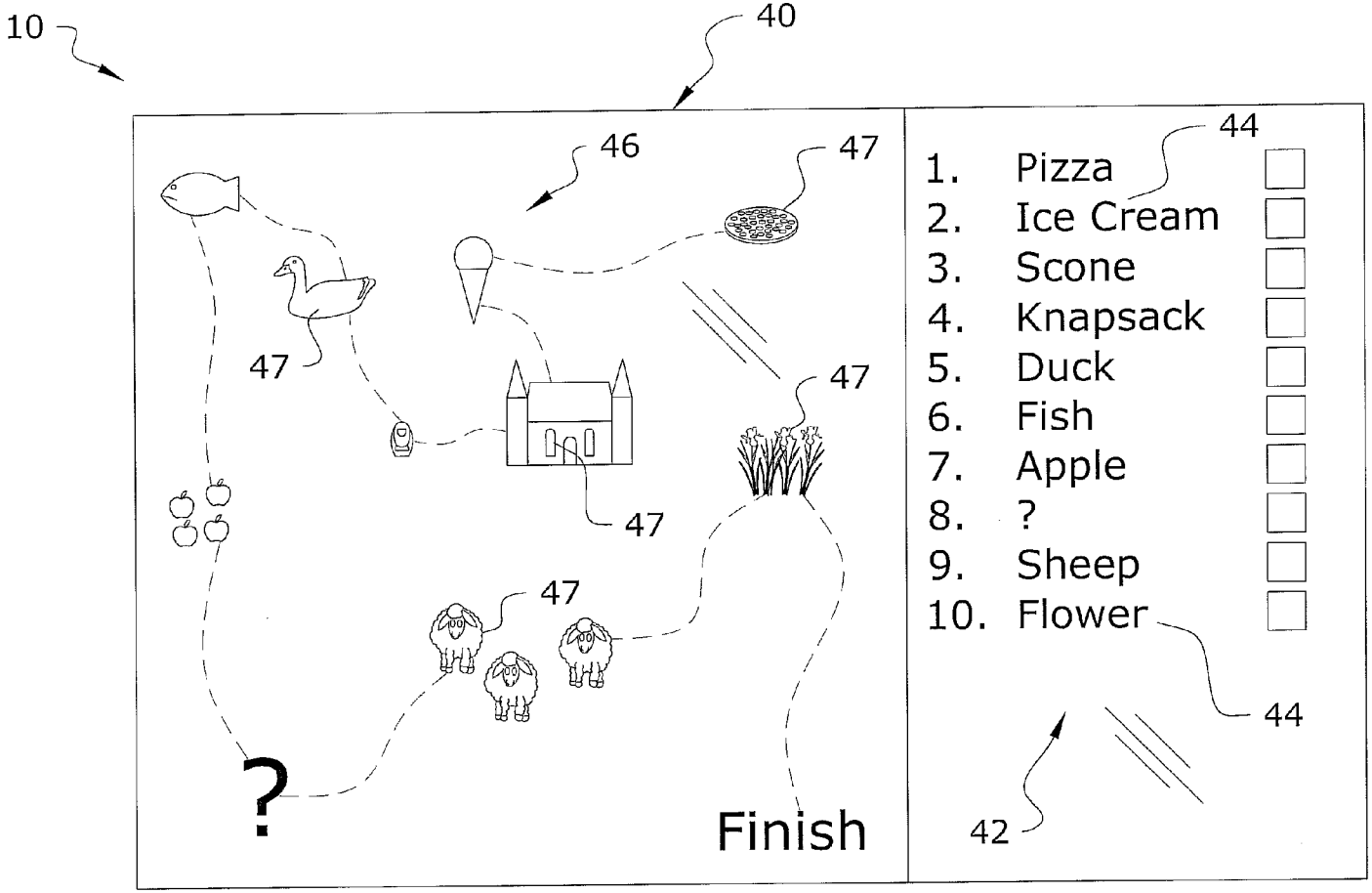

When beginning the game play, each player chooses a hiker token 30, a die 36 and a writing tool 38. Game play generally lasts approximately 30 minutes and involves 2-6 players. The hiker token 30, the die 36 and the writing tool 38 are preferably color coordinated. Each player also chooses a progress card 40 places their respective hiker token 30 on a first checkpoint 22*a* (e.g. "Scone" as illustrated in FIG. 3) listed on the checklist 42 of their progress card 40. It is appreciated that each player has 1 starting checkpoint 22*a*, a plurality of intermediary checkpoints 22*b*, and 1 final checkpoint 22*c* sequenced on their progress card 40 that they must follow during game play. The starting checkpoint 22*a*, intermediary checkpoints 22*b*, and final checkpoint 22*c* may be the same or different for any player depending on the progress card 40 that is chosen either randomly or by choice.

The players roll their dice 36 to determine who begins game play, wherein the highest total die count preferably wins and thus associated player begins first. The rotation following the first player may continue in various manners, such as clockwise. The first player now rolls their dice 36 and moves their hiker token 30 toward the next checkpoint 22*b* (e.g. "Pizza" as illustrated in FIG. 3) to collect another souvenir 34. Once the souvenir 34 has been collected (i.e. user has reached the checkpoint 22), the respective destination 44 may be "checked" from the checklist 42 of the progress card 40 and the souvenir 34 may be placed over the respective illustration 47 on the map 46 to further remind the user which checkpoints 22*a*, 22*b*, 22*c* they have reached and which they will move to next.

In the preferred embodiment, the souvenirs 34, pictorial representations 22*d* of the checkpoints 22*a*, 22*b*, 22*c*, and illustrations 47 on the progress cards 40 represent likenesses of a pizza, a scone, ice cream, a duck, a fish, a flower, a sheep, an apple, a mystery symbol, and a knapsack. It is appreciated that other likenesses may be used in alternate embodiments.

It is appreciated that the players must move their hiker token 30 in an order as prescribed on their progress card 40, wherein different players may have different ordered progress cards 40 (i.e. must go to the checkpoints 22*a*, 22*b*, 22*c* in a different order) and thus may not follow the same path of the pathway 21. For example, a first player might have the "Scone" as the starting checkpoint 22*a*, then the "Pizza" as the next checkpoint 22*b*, then the "Ice Cream" as the following checkpoint 22*b*, and so on, wherein a second player might have the "Pizza" as the starting checkpoint 22*a*, then the "Ice Cream" as the next checkpoint 22*b*, then the "Scone" as the following checkpoint 22*b*, and so on.

As a player reaches each checkpoint 22*a*, 22*b*, 22*c* prescribed by their progress card 40, the associated name 44 of the checkpoint 22*a*, 22*b*, 22*c* is marked on their progress card 40 in the provide checklist 42 (e.g. with a checkmark, X, etc.). It is appreciated that the first destination name 44 of the checklist 42 representing the first checkpoint 22*a* (e.g. "Scone" as illustrated in FIG. 3) is inherently "checked" at the beginning of game play, in that the player begins their game play at the first checkpoint 22*a* described by the first destination name 44 and illustration 46. Once the player completes their checklist 42 (i.e. reaches all the starting and intermediary checkpoints 22*a*, 22*b*), the player must be the first to reach the final checkpoint 22*c* "Swan Hotel" to win the game. It is appreciated that the final checkpoint 22*c* may be the same for all of the players or different and may or may not be represented on the progress card 40.

Along the way to each checkpoint 22*b*, 22*c* prescribed by the associated next destination 44 on the progress card 40, the player may encounter various detours in which their associated hiker token 30 has landed upon. Some of the detours include a bog hazard detour 24*a* (player must follow the path around a bog area 26), a bog space 24*b* (player is retained in the bog space 24*b* for two turns), a "Wrong Way Inn" entrance 24*c*, a sheep pile 24*d* (player is retained in the sheep pile space 24*d* for one turn), a maze space with a star 24*e* or a maze space with a diamond 24*f* (player is allowed to move through the maze 27 more quickly or be sent backwards depending on the direction of the player).

Figure 2B:
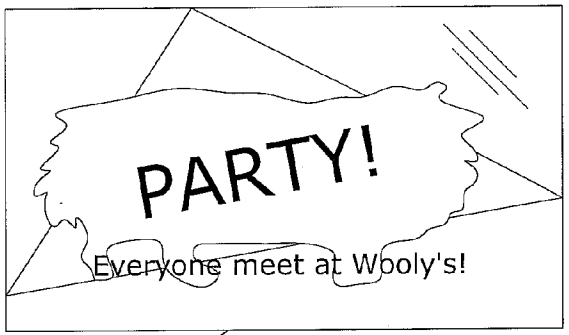
FIG. 2*a*-2*c* are illustrations of playing cards.
Figure 2A:
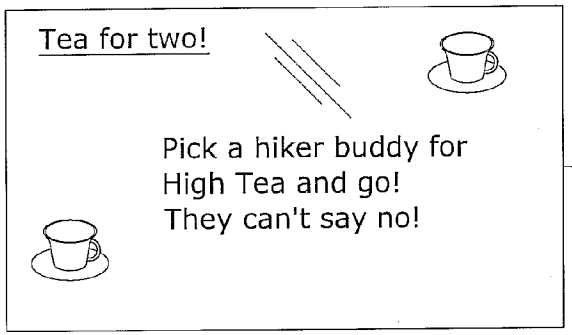
Figure 2C:
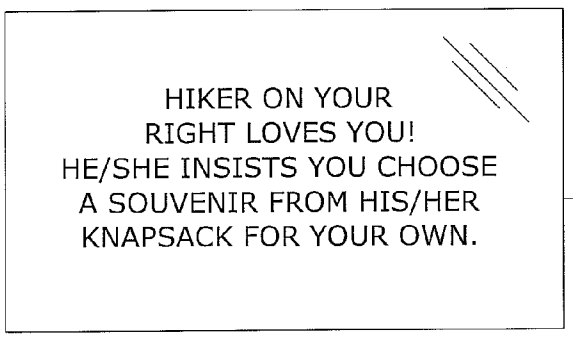

Once a player chooses a direction in which their hiker token 30 will follow to the next destination name 44, the player may not change the direction of their hiker token 30 to avoid any space (e.g. detour space) or other obstacle unless the hiker token 30 comes to a intersecting space 25 that gives them the choice of direction along a different part of the pathway 21 or the hiker token 30 is required to move by various playing cards 32 picked up when landing on various card spaces 31 on the pathway 21, such as a "Swan" card or a "Tarn" card. The "Swan" card and the "Tarn" card may be chosen by the respective player of the played hiker token 30 or another player of another hiker token 30. The "Swan" card or "Tarn" card may also affect other players, such as illustrated in FIGS. 2*a* through 2*c*, wherein all players must advance their respective hiker token 30 to a given checkpoint 22*a*, 22*b*, 22*c*. Although, a player having a "Hold" card may refrain from advancing their hiker token 30 if desired. After being advanced to a given checkpoint 22*a*, 22*b*, 22*c*, the players must advance their hiker tokens 30 in-order as prescribed by their checklist 42 from the current checkpoint 22*a*, 22*b*, 22*c*.

In the event that the hiker token 30 is advanced to a checkpoint 22*a*, 22*b*, 22*c* by a "Swan" card or a "Tarn" card, the player may "check" the destination name 44 off of their checklist 42 on their progress card 40 even if the destination 44 is out of sequence. The player may then continue their journey with the hiker token 30 to the next checkpoint 22*b*, 22*c* as specified on the progress card 40 in the listed sequence.

More than one hiker token 30 may occupy a checkpoint 22*a*, 22*b* at any given time. However, any other space 23, 24*a*, etc. along the pathway 21 may not be occupied by more than one hiker token 30 and the latest arrived hiker token 30 must move to the next associated space. It is also appreciated that players need not reach a given checkpoint 22*b* to "check" the destination 44 off of their checklist 42 of their progress card 40 by exact count on their die 36. As an example, if a player rolls a 6 and only needs a count of 4 to land on a checkpoint 22*b*, the player must stop on that checkpoint 22*b* and forfeit the remaining count of 2 left on their die. If a player passes by a checkpoint 22*a*, 22*b* they have already check off, they need not stop at that checkpoint 22*a*, 22*b* and may pass through.

Figure 4:
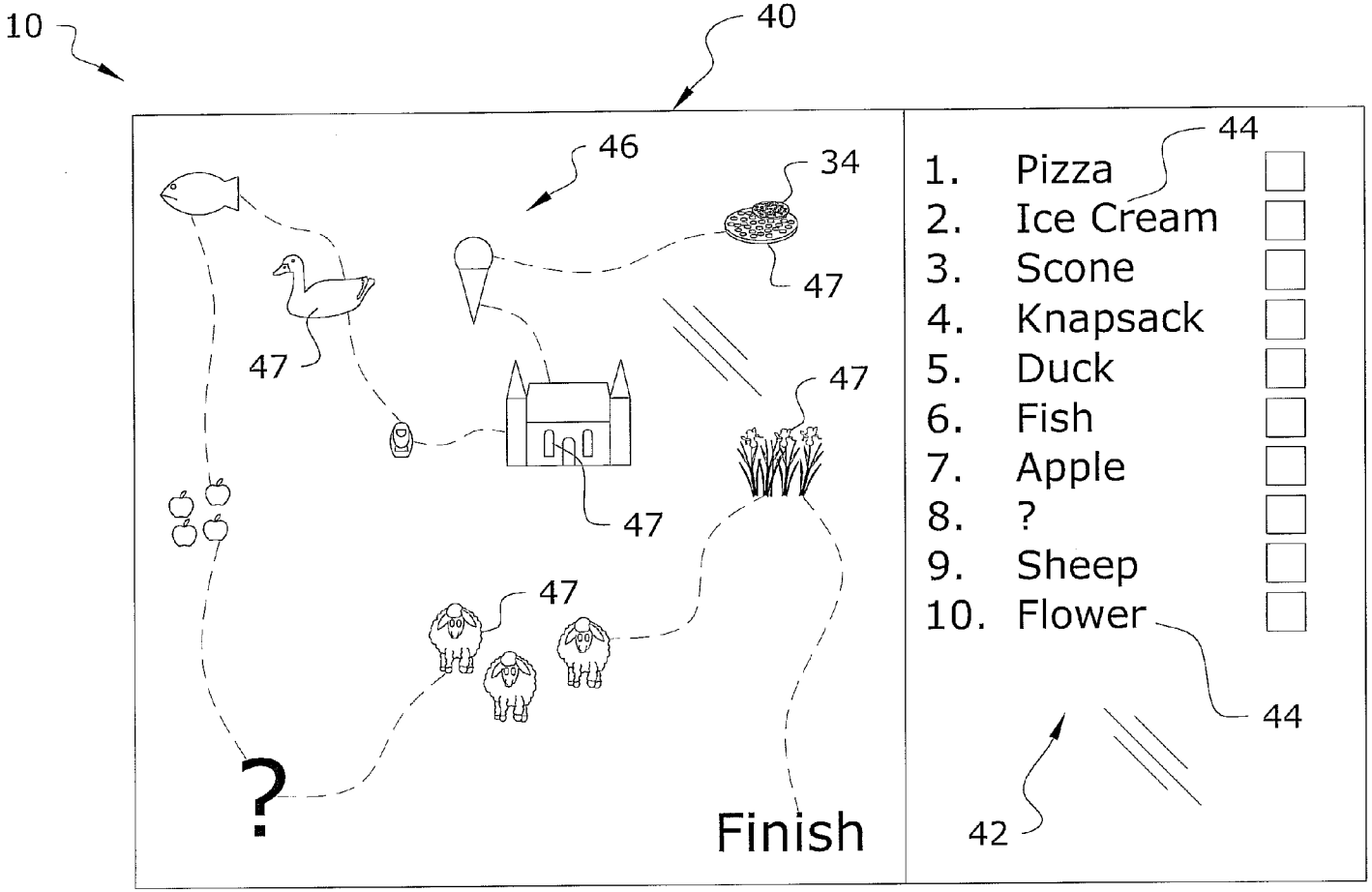
FIG. 4 is an illustration of a progress card partially completed.
Figure 5:
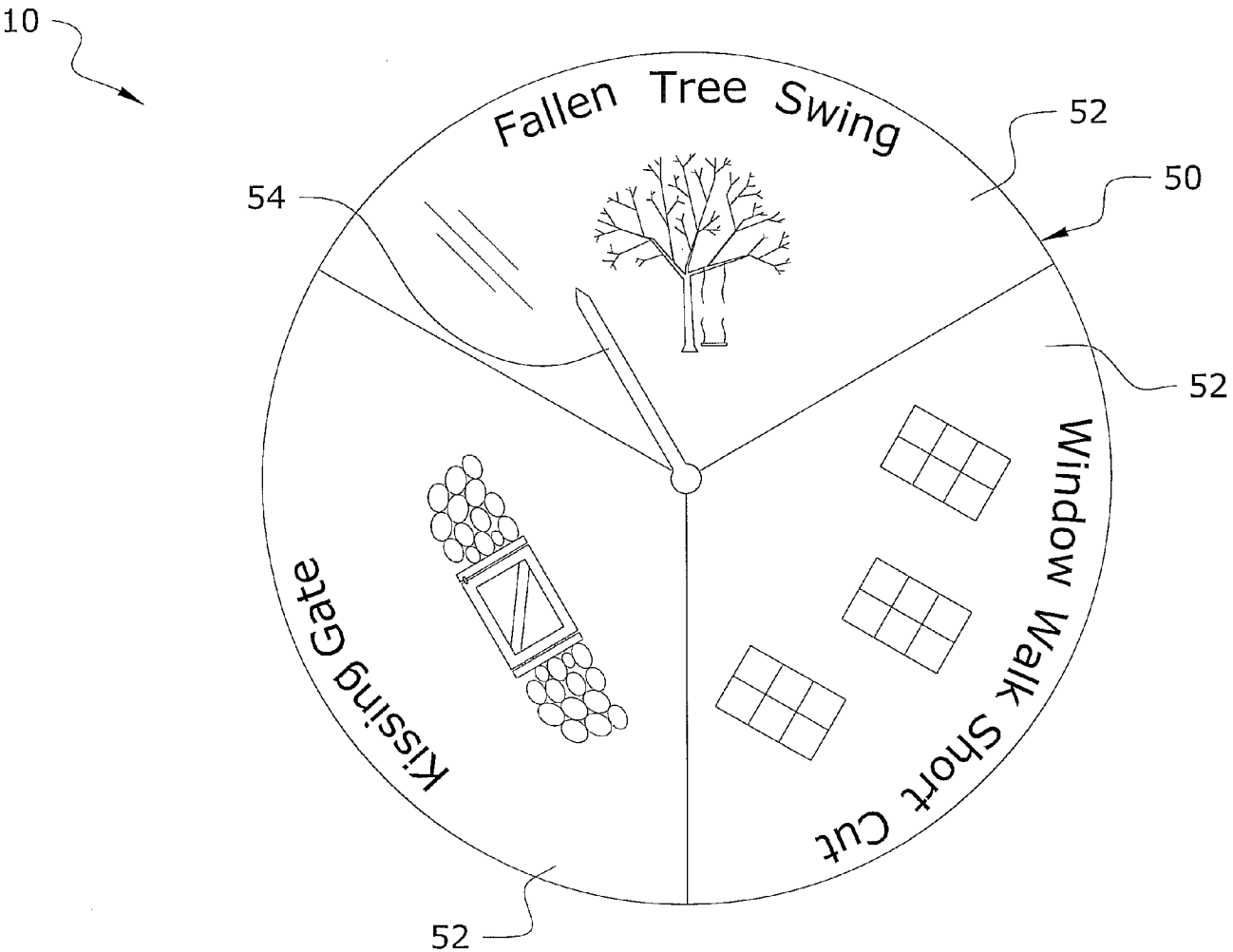
FIG. 5 is an illustration of the spinner.
Figure 6:
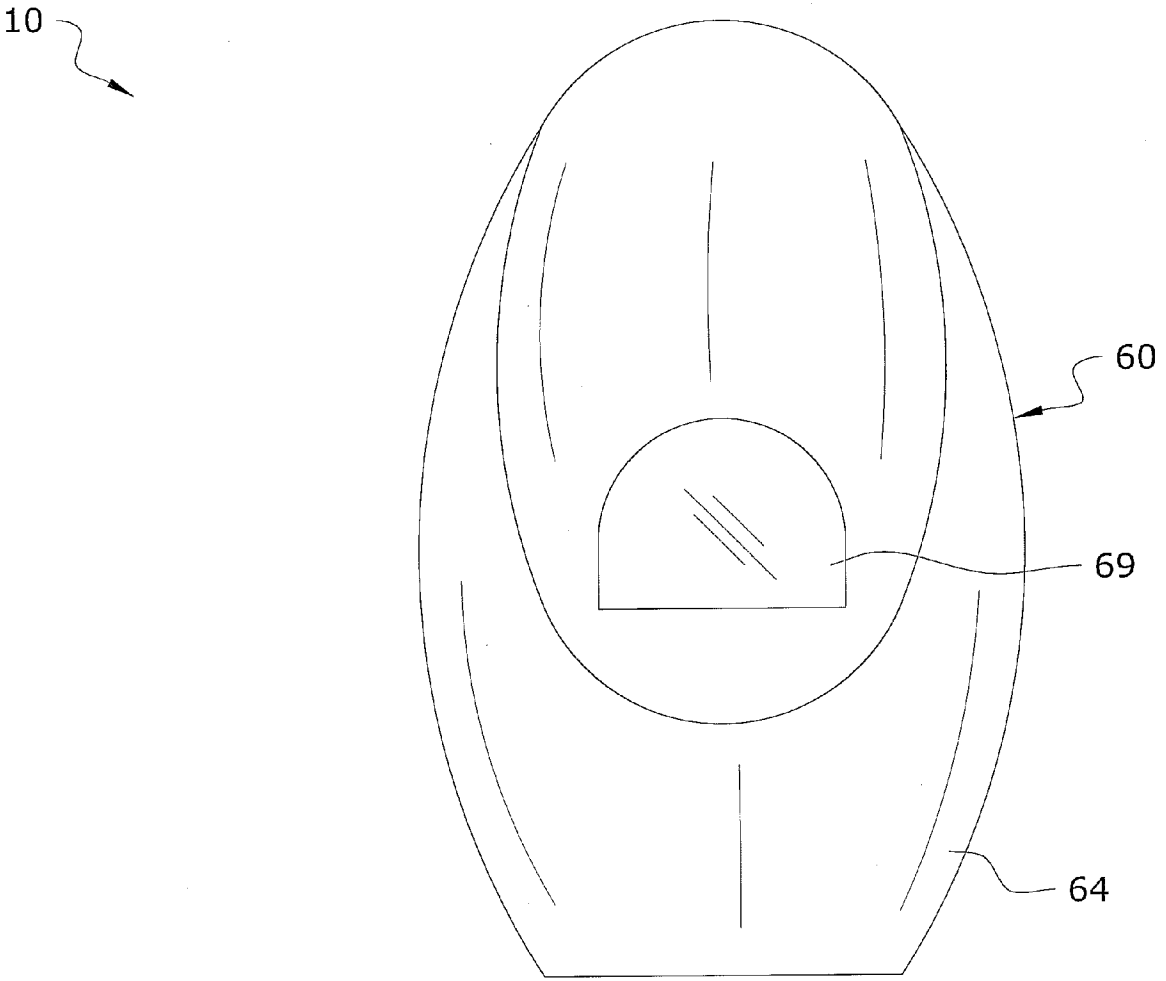
FIG. 6 is a front view of the carrying case.
Figure 7:
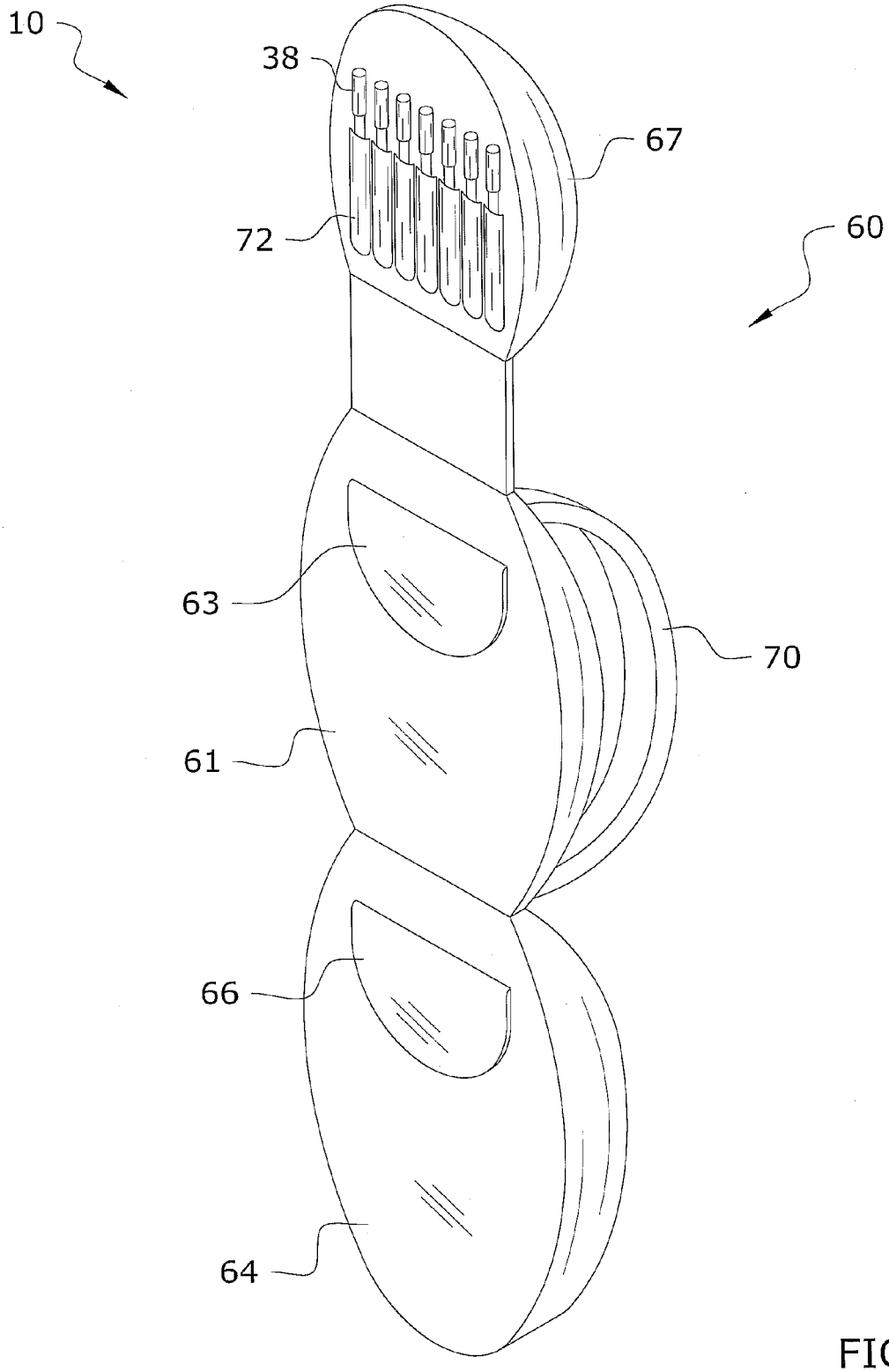
FIG. 7 is an upper perspective view of the carrying case in an open position.
Figure 8:
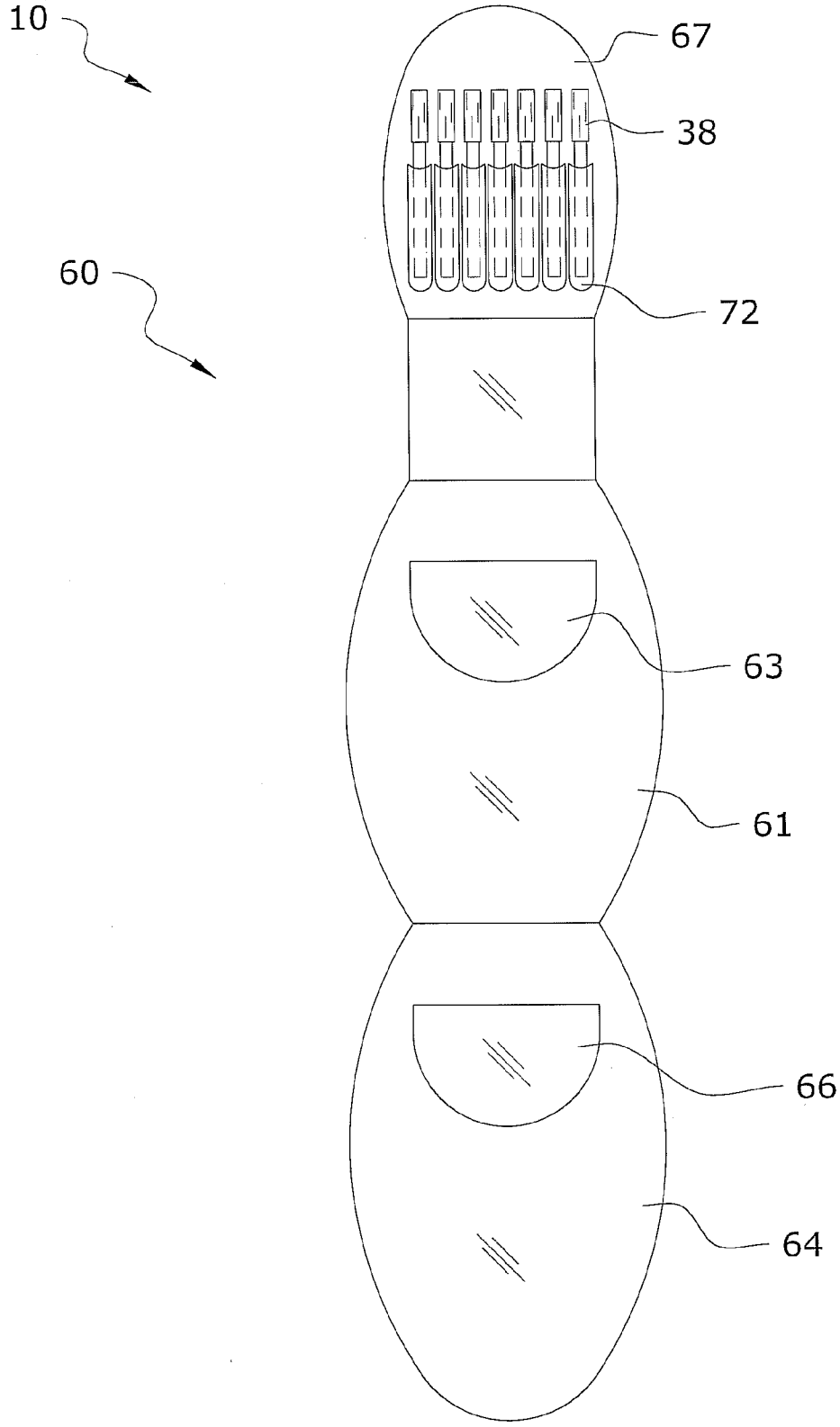
FIG. 8 is a front view of the carrying case in an open position.

Several spaces also include the use of a spinner 50 as illustrated in FIG. 4. When landing on a "Fallen Tree Swing" space 29*a*, the hiker token 30 must remain there until their next turn at which time the player may spin the arrow 54 to see if the arrow 54 matches up with the appropriate spot 52 on the spinner 50. If the arrow 54 matches the appropriate space 29*a* (i.e. "Fallen Tree Swing"), the player may roll their dice and may advance their hiker token 30 toward the next checkpoint 22. If not, the player must remain on the "Fallen Tree Swing" space 29*a* until their next turn and try again.

Another location that includes the use of the spinner 50 is the "Window Walk Shortcut" 29*b* and 29*c*. The "Window Walk Shortcut" preferably is represented by two spaces 29*b* and 29*c* upon the pathway 21 of the game board 20. The two spaces 29*b* and 29*c* are connected by both a complex, long maze 27 and also by a shortcut 28*a* in which the shortcut 28*a* is much shorter than the maze 27. When landing on one of the two "Window Walk Shortcut" spaces 29*b* and 29*c*, the player spins the arrow 54 upon the spinner 50. If the arrow 54 matches up with the appropriate spot 52 (i.e. "Window Walk Shortcut"), the player immediately rolls the die 36 and is allowed to advance their hiker token 30 through the shortcut 28*a*. If the arrow 54 does not match up with the appropriate spot 52, the player immediately rolls the die 36 and must advance through the maze 27. To stop or land on the "Window Walk Shortcut", the player need not roll the exact amount on the die, wherein the player simply forfeits the remaining count upon the die when reaching the "Window Walk Shortcut".

Another location that includes the use of the spinner 50 is the "Kissing Gate" 29*d*. When landing on a "Kissing Gate" space 29*d* or being sent to the "Kissing Gate" space 29*d* via a "Swan" card or a "Tarn" card, the hiker token 30 must remain there until their next turn at which time the player may spin the arrow 54 to see if the arrow 54 matches up with the appropriate spot 52 on the spinner 50. If the arrow 54 matches the appropriate space 29*d* (i.e. "Kissing Gate"), the player may roll their die and advance their hiker token 30 toward the next checkpoint 22. If not, the player must remain on the "Kissing Gate" space 29*d* until their next turn and try again.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A game board having alternate sequences of game play for each player, comprising:

a game board including at least one pathway, wherein said at least one pathway includes a plurality of spaces;

a plurality of tokens movable along said plurality of spaces, wherein each game player is assigned a token of said plurality of tokens;

a chance element to determine a number of spaces of said plurality of spaces along said at least one pathway for said token to move;

a plurality of checkpoints positioned along said plurality of spaces of said at least one pathway; and a plurality of progress cards each sequencing said plurality of checkpoints placed as spaces on a pathway in a specific order, wherein said specific order is different for each of said plurality of progress cards;

wherein said each game player is assigned a progress card of said plurality of progress cards to layout said specific order that said plurality of checkpoints are to be reached by said token along said at least one pathway for said each game player.

2. The game board of claim 1, wherein said plurality of checkpoints each include a pictorial representation upon said game board.

3. The game board of claim 1, wherein said plurality of progress cards each include a plurality of illustrations representing each of said plurality of checkpoints.

4. The game board of claim 3, wherein said plurality of illustrations are arranged in said specific order upon each of said plurality of progress cards.

5. The game board of claim 4, wherein each of said plurality progress cards includes a map including said plurality of illustrations in said specific order.

6. The game board of claim 1, wherein each of said plurality of progress cards includes a checklist listing said plurality of checkpoints in said specific order.

7. The game board of claim 1, wherein said at least one pathway is representative of a hiking trail.

8. The game board of claim 1, wherein said plurality of spaces include a plurality of intersection spaces.

9. The game board of claim 1, including a plurality of souvenirs collected by said each player once reaching a checkpoint of said plurality of checkpoints.

10. The game board of claim 1, wherein said plurality of spaces include a plurality of detour spaces.

11. The game board of claim 1, including a plurality of playing cards to provide situations when drawn for said each player to alter game play.

12. The game board of claim 1, including a spinner to provide situations when spun for said each player to alter game play.

13. A game board having alternate sequences of game play for each player, comprising:

a game board including at least one pathway, wherein said at least one pathway includes a plurality of spaces;

wherein said at least one pathway is representative of a hiking trail;

wherein said plurality of spaces include a plurality of detour spaces;

wherein said plurality of spaces include a plurality of intersection spaces;

a plurality of tokens movable along said plurality of spaces, wherein each game player is assigned a token of said plurality of tokens;

wherein said plurality of tokens are representative of hikers;

a chance element to determine a number of progress spaces of said plurality of spaces along said at least one pathway for said token to move;

a plurality of checkpoint spaces positioned along said plurality of spaces of said at least one pathway;

wherein said plurality of checkpoint spaces each include a pictorial representation;

wherein said plurality of checkpoint spaces each include a building structure represented alongside each of said plurality of checkpoint spaces; and a plurality of progress cards separate from said game board;

wherein each of said plurality of progress cards sequence said plurality of checkpoint spaces placed on a pathway in a specific order;

wherein said specific order is different for each of said plurality of progress cards;

wherein said plurality of progress cards are laminated to be reusable;

wherein said plurality of progress cards each include a plurality of illustrations representing each of said plurality of pictorial representations of said plurality of checkpoint spaces;

wherein each of said plurality progress cards include a map including said plurality of illustrations arranged in said specific order;

wherein each of said plurality of progress cards includes a checklist listing said plurality of checkpoint spaces in said specific order;

wherein said each game player is assigned a progress card of said plurality of progress cards to layout said specific order that said plurality of checkpoint spaces are to be reached by said token along said at least one pathway for said each game player;

wherein said plurality of checkpoint spaces include a starting checkpoint space, a plurality of intermediary checkpoint spaces, and a final checkpoint space;

wherein game play is won when said final checkpoint space is reached by said token.

14. The game board of claim 13, including a plurality of souvenirs collected by said each player once reaching a checkpoint space of said plurality of checkpoint spaces, wherein said plurality of souvenirs comprise likenesses of a pizza, a scone, ice cream, a duck, a fish, a flower, a sheep, an apple, a mystery symbol, and a knapsack.

15. The game board of claim 13, including a plurality of playing cards to provide situations when drawn for said each player to alter game play.

16. The game board of claim 13, including a spinner to provide situations when spun for said each player to alter game play.

* * * * *